US009273693B2

(12) United States Patent
Carter et al.

(10) Patent No.: US 9,273,693 B2
(45) Date of Patent: Mar. 1, 2016

(54) COMPRESSOR COMPRISING A SENSOR ARRANGEMENT

(75) Inventors: Jeffrey Carter, Huddersfield (GB); Nicholas K Sharp, Stanley (GB)

(73) Assignee: Cummins Ltd., Huddersfield (GB)

( * ) Notice: Subject to any disclaimer, the term of this patent is extended or adjusted under 35 U.S.C. 154(b) by 840 days.

(21) Appl. No.: 13/358,201

(22) Filed: Jan. 25, 2012

(65) Prior Publication Data

US 2012/0213627 A1 Aug. 23, 2012

(30) Foreign Application Priority Data

Jan. 25, 2011 (GB) ..... 1101291.1

(51) Int. Cl.
*F04D 29/42* (2006.01)
*F04D 27/00* (2006.01)

(52) U.S. Cl.
CPC ..... *F04D 27/001* (2013.01); *F04D 29/4206* (2013.01); *Y10T 29/49236* (2015.01)

(58) Field of Classification Search
CPC ..... F04D 27/001; F04D 29/40; F04D 29/403; F04D 29/406; F04D 29/42; F04D 29/4206
USPC ..... 415/118, 204, 205, 206
See application file for complete search history.

(56) References Cited

U.S. PATENT DOCUMENTS 3,612,710 A * 10/1971 Mount ..... 415/14
3,901,620 A * 8/1975 Boyce ..... 415/1
4,356,695 A * 11/1982 Sumi et al. ..... 60/602
5,960,631 A * 10/1999 Hayashi ..... 60/602
6,202,414 B1 * 3/2001 Schmidt et al. ..... 60/612
6,623,239 B2 * 9/2003 Sahay et al. ..... 415/119
7,631,498 B2 * 12/2009 Greentree ..... 60/605.1
7,905,702 B2 * 3/2011 Stabley et al. ..... 415/118
7,911,201 B2 * 3/2011 Ante et al. ..... 324/173
8,043,047 B2 * 10/2011 Ante et al. ..... 415/118
8,070,416 B2 * 12/2011 Gottemoller et al. ..... 415/53.3

(Continued)

FOREIGN PATENT DOCUMENTS

EP 0685652 A3 6/1997
EP 2107248 A2 10/2009

(Continued)

OTHER PUBLICATIONS

Search Report GB1101291.1, May 9, 2011, Cummins Limited, UK Intellectual Property Office, Newport, South Wales.

*Primary Examiner* — Ninh H Nguyen
*Assistant Examiner* — Christopher R Legendre
(74) *Attorney, Agent, or Firm* — Taft Stettinius & Hollister LLP

(57) ABSTRACT

A compressor comprises a housing defining an inlet, a volute, an outlet, and a compressor chamber between the inlet and the outlet within which a compressor wheel is rotatably mounted. The housing has discrete attached first and second housing portions, the first housing portion defining at least part of the inlet and the second housing portion defining at least part of a volute of the outlet. The first housing portion has a conductive element for conducting an electric signal and a second sensor arrangement in sensing communication with the inlet. The compressor further comprises a first sensor arrangement, the first sensor arrangement being configured such that it is in sensing communication with the volute or outlet and such that it is electrically connected to the conductive element.

13 Claims, 2 Drawing Sheets

(56) References Cited

U.S. PATENT DOCUMENTS

| | | | | |
|---|---|---|---|---|
| 8,522,549 | B2 * | 9/2013 | Sumser et al. | 60/605.1 |
| 2004/0223847 | A1 * | 11/2004 | Cvjeticanin et al. | 415/206 |
| 2005/0155349 | A1 * | 7/2005 | Sugiura et al. | 60/605.1 |
| 2008/0232950 | A1 * | 9/2008 | Stabley et al. | 415/1 |
| 2009/0060716 | A1 | 3/2009 | Ante et al. | |
| 2009/0121706 | A1 * | 5/2009 | Ante et al. | 324/173 |
| 2010/0232955 | A1 * | 9/2010 | Schick et al. | 415/204 |
| 2012/0213627 | A1 * | 8/2012 | Carter et al. | 415/121.3 |

FOREIGN PATENT DOCUMENTS

| | | | |
|---|---|---|---|
| GB | 1503905 | | 3/1978 |
| JP | 2000345851 | A | 12/2000 |
| WO | 2007085535 | A1 | 8/2007 |

* cited by examiner

COMPRESSOR COMPRISING A SENSOR ARRANGEMENT

RELATED APPLICATIONS

The present application is related to, and claims priority to United Kingdom Patent Application No. 1101291.1 filed on Jan. 25, 2011, which is incorporated herein by reference.

The present invention relates to a compressor and to a method of assembling a compressor.

Turbochargers are well known devices for supplying air to the intake of an internal combustion engine at pressures above atmospheric (boost pressures). A conventional turbocharger essentially comprises an exhaust gas driven turbine wheel mounted on a rotatable shaft within a turbine housing. The exhaust gas may be supplied from the engine exhaust manifold. Rotation of the turbine wheel rotates a compressor wheel mounted on the other end of the shaft within a compressor housing. The compressor wheel delivers compressed air to the engine intake manifold. The turbocharger shaft is conventionally supported by journal and thrust bearings, including appropriate lubricating systems, located within a central bearing housing connected between the turbine and compressor wheel housing.

The turbine stage of a conventional turbocharger comprises: a turbine housing defining a turbine chamber within which the turbine wheel is mounted; an annular inlet passageway defined in the housing between facing radially extending walls arranged around the turbine chamber; an inlet arranged around the inlet passageway; and an outlet passageway extending from the turbine chamber. The passageways and chamber communicate such that pressurised exhaust gas admitted to the inlet flows through the inlet passageway to the outlet passageway via the turbine chamber and rotates the turbine wheel. It is known to improve turbine performance by providing vanes, referred to as nozzle vanes, in the inlet passageway so as to deflect gas flowing through the inlet passageway towards the direction of rotation of the turbine wheel.

Turbines of this kind may be of a fixed or variable geometry type. Variable geometry turbines differ from fixed geometry turbines in that the size of the inlet passageway can be varied to optimise gas flow velocities over a range of mass flow rates so that the power output of the turbine can be varied in line with varying engine demands.

The compressor of a conventional turbocharger comprises: a compressor housing defining a compressor chamber within which the compressor wheel is mounted such that it may rotate about an axis; a substantially axial inlet passageway defined by the compressor housing; a substantially annular outlet passageway defined in the compressor housing between facing radially extending walls arranged around the compressor chamber; a volute arranged around the outlet passageway; and an outlet in flow communication with the volute. The passageways and compressor chamber communicate such that gas (for example, air) at a relatively low pressure is admitted to the inlet and is pumped, via the compressor chamber, outlet passageway and volute, to the outlet by rotation of the compressor wheel. The gas at the outlet is generally at a greater pressure than the relatively low pressure of the gas which is admitted to the inlet. The gas at the outlet may then be pumped downstream of the compressor outlet by the action of the compressor wheel.

In some compressor applications, at least one sensor may be used to measure at least one property of gas which is admitted to the compressor inlet, and/or of gas which is pumped downstream of the compressor outlet. Measuring at least one property of gas which is admitted to the compressor inlet, and/or of gas which is pumped downstream of the compressor outlet, may be representative of operating characteristics of the compressor. Such a sensor may be located remotely from the compressor. For example, a sensor which detects a property of gas which is pumped downstream of the compressor outlet may be located at an inlet manifold of an engine of which the compressor forms part. A sensor of this type may provide measurements which are inaccurate and/or not sufficiently representative of properties of gas within the compressor (and hence not sufficiently representative of operating characteristics of the compressor). Furthermore, a sensor of this type may be complicated and/or costly to install and integrate with engine electronics.

It is one object of the present invention to provide a compressor which enables convenient location of at least one sensor which can be used to determine operating characteristics of the compressor. It is also an object to provide an alternative or an improved compressor. It is a further object to obviate or mitigate at least one of the disadvantages of known compressors, whether described above or otherwise.

According to a first aspect of the present invention there is provided a compressor comprising a housing defining an inlet, a volute, an outlet, and a compressor chamber between the inlet and the outlet within which a compressor wheel is rotatably mounted, the housing having discrete attached first and second housing portions, the first housing portion defining at least part of the inlet and the second housing portion defining at least part of the volute, the first housing portion having a conductive element for conducting an electric signal, wherein the compressor further comprises a first sensor arrangement, the first sensor arrangement being configured such that it is in sensing communication with the volute or outlet, and such that it is electrically connected to the conductive element.

The first housing portion may have a second sensor arrangement in sensing communication with the inlet.

The second housing portion may comprise the first sensor arrangement.

The first housing portion may comprise the first sensor arrangement.

The first sensor arrangement may be placed in sensing communication with the volute or outlet via a bore or through-bore in the second housing portion.

The bore or through-bore may extend from adjacent the first housing portion, generally away from the first housing portion.

The first housing portion may be formed from a plastic material.

The second sensor arrangement may comprise at least one of a pressure sensor, a temperature sensor and a mass flow sensor.

The first sensor arrangement may comprise at least one of a pressure sensor, a temperature sensor and a mass flow sensor.

The first housing portion may further comprise an electrical connector which is electrically linked both to the second sensor arrangement and, via the conductive element, to the first sensor arrangement.

The compressor may further comprise a generally annular insert which is received by the inlet, wherein at least part of the second sensor arrangement is mounted on the insert.

According to a second aspect of the present invention there is provided a method of constructing a compressor, the compressor having a housing defining an inlet, a volute, an outlet, and a compressor chamber between the inlet and the outlet within which a compressor wheel is rotatably mounted, wherein the housing comprises first and second discrete housing portions, the first housing portion defining at least part of the inlet and the second housing portion defining at least part of the volute, the first housing portion having a conductive element for conducting an electric signal, the compressor further comprising a first sensor arrangement, the method comprising: attaching the first and second housing portions such that the first sensor arrangement is placed in sensing communication with the volute or outlet, and/or such that the first sensor arrangement is electrically connected to the conductive element.

The first housing portion may have a second sensor arrangement in sensing communication with the inlet.

A specific embodiment of the present invention will now be described, by way of example only, with reference to the accompanying drawings, in which.

Figure 1:
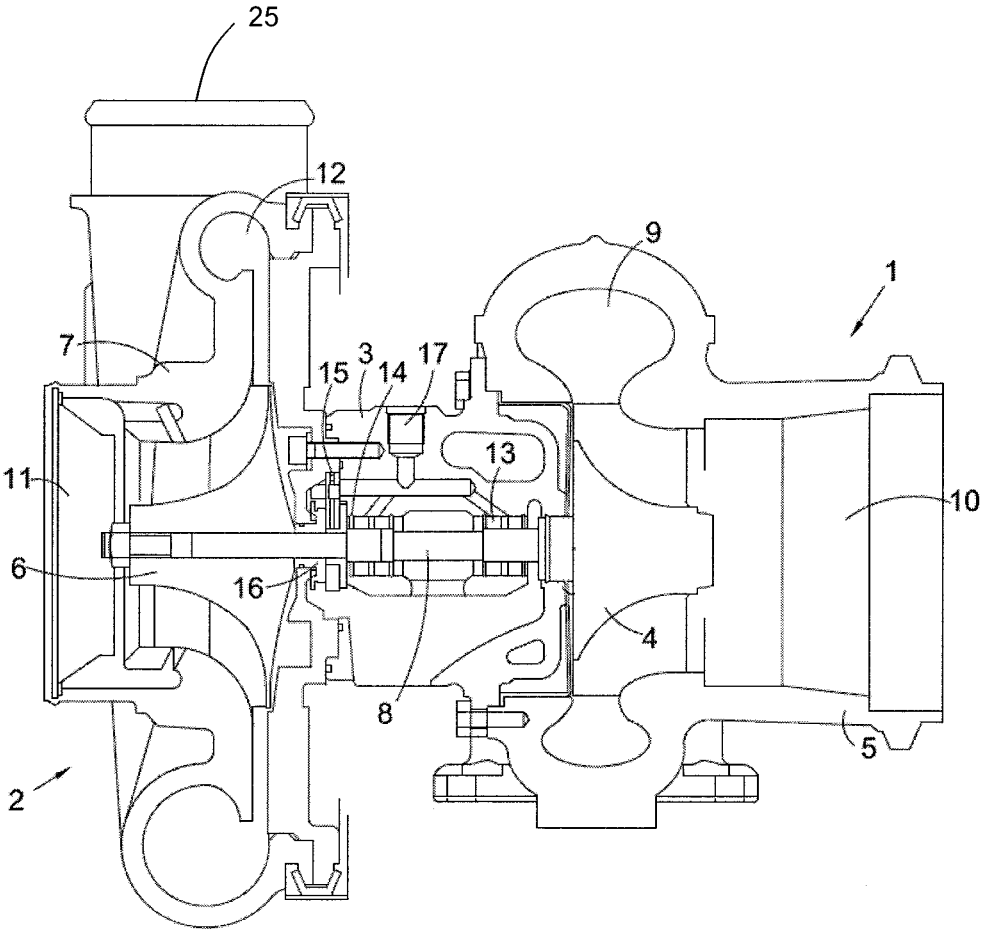
FIG. 1 shows a cross-sectional view of a turbocharger.

Referring to FIG. 1, the turbocharger comprises a turbine 1 joined to a compressor 2 via a central bearing housing 3. The turbine 1 comprises a turbine wheel 4 for rotation within a turbine housing 5. Similarly, the compressor 2 comprises a compressor wheel 6 which can rotate within a compressor housing 7. The compressor housing 7 defines a compressor chamber within which the compressor wheel 6 can rotate. The turbine wheel 4 and compressor wheel 6 are mounted on opposite ends of a common turbocharger shaft 8 which extends through the central bearing housing 3.

The turbine housing 5 has an exhaust gas inlet volute 9 located annularly around the turbine wheel 4 and an axial exhaust gas outlet 10. The compressor housing 7 has an axial air intake passage 11 and a volute 12 arranged annularly around the compressor chamber. The volute 12 is in gas flow communication with a compressor outlet 25. The turbocharger shaft 8 rotates on journal bearings 13 and 14 housed towards the turbine end and compressor end respectively of the bearing housing 3. The compressor end bearing 14 further includes a thrust bearing 15 which interacts with an oil seal assembly including an oil slinger 16. Oil is supplied to the bearing housing from the oil system of the internal combustion engine via oil inlet 17 and is fed to the bearing assemblies by oil passageways 18. It will be appreciated that any appropriate bearings may be used to support turbocharger shaft within the turbocharger. For example, rolling element bearings may be used instead of journal bearings.

In use, the turbine wheel 4 is rotated by the passage of exhaust gas from the annular exhaust gas inlet 9 to the exhaust gas outlet 10, which in turn rotates the compressor wheel 6 which thereby draws intake air through the compressor inlet 11 and delivers boost air to the intake of an internal combustion engine (not shown) via the volute 12 and then the outlet 25.

In certain applications it may be desirable to measure operating characteristics of part of the turbocharger, such as the compressor. It is known to measure certain characteristics of the air flowing into the compressor and/or of the air flowing out of the compressor, and to use these measurements to determine operating characteristics of the compressor. For example, the temperature of the air flowing into and/or out of the compressor may be measured. Furthermore, the mass flow rate of gas flowing into and/or out of the compressor may be measured. In some situations a sensor which is used to measure one of the properties of the gas flowing into or out of the compressor may be located at a position which is remote from the compressor. For example, the sensor may be located at the inlet manifold of the engine to which the turbocharger is attached or at an intake system of the engine, upstream of the compressor. For instance, in the case where the sensor is at an intake system of the engine, the sensor may be located in an air filter box. Using a sensor in this manner to measure operating characteristics of the compressor may be disadvantageous. For example, locating at least one of the sensors which is used to determine the operating characteristics of the compressor at a position which is remote from the compressor may be complicated and/or costly. This is because the sensor has to be installed in a part of the engine which is some distance from the compressor and also because the sensor may be difficult to integrate with the engine electronics.

Furthermore, the use of at least one sensor which is located remotely from the compressor may be disadvantageous because, due to the sensor being located some distance away from the compressor, measurements made by the sensor of a property of the gas may not be representative of said property of the gas within the compressor, and hence the operating conditions of the compressor.

Figure 2:
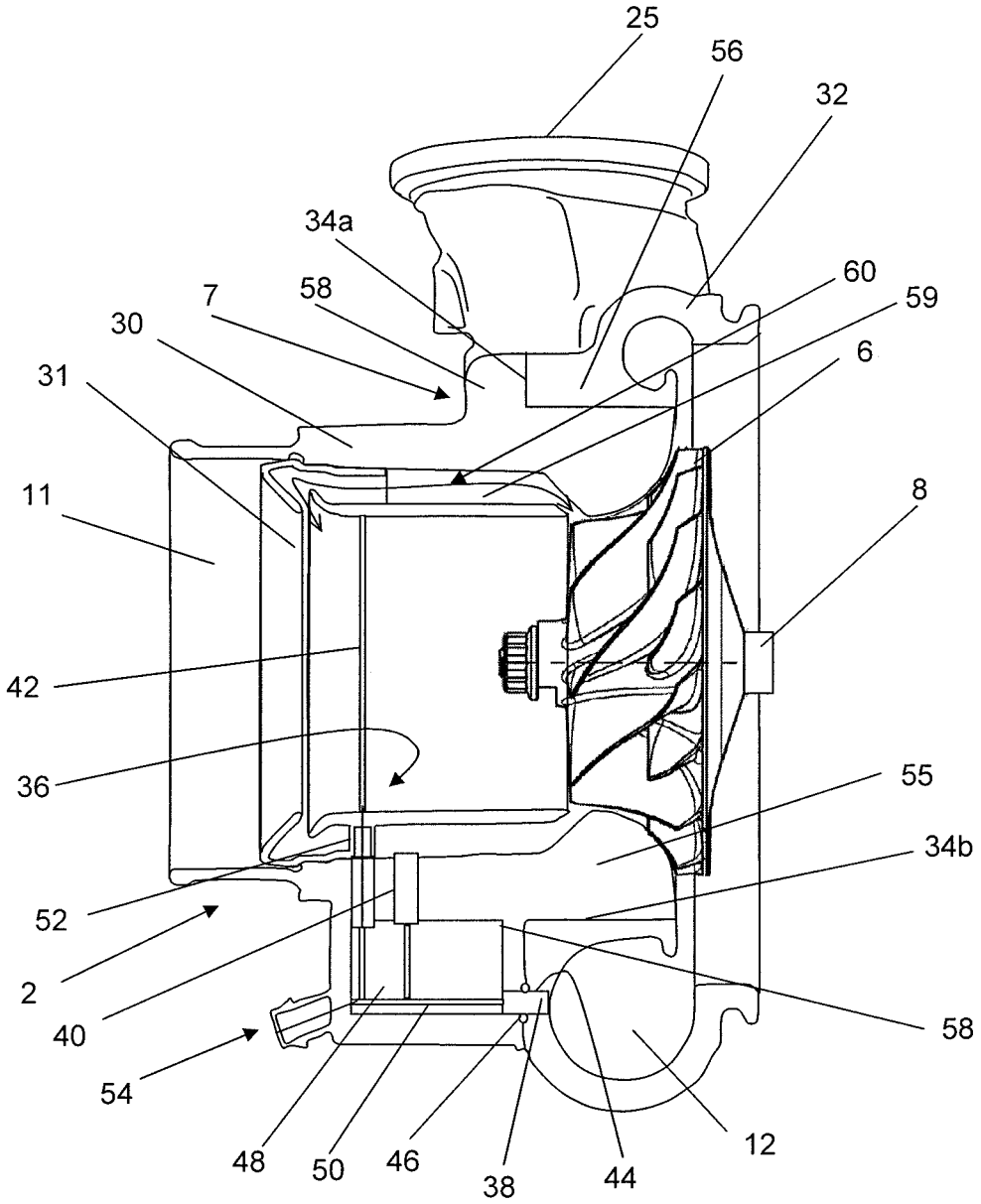
FIG. 2 shows a cross-sectional view of a compressor according to an embodiment of the present invention which may form part of a turbocharger.

FIG. 2 shows a cross-sectional view through a compressor in accordance with an embodiment of the present invention. Equivalent features of the compressor shown in FIG. 2 to those of the compressor shown in FIG. 1 have been given the same numbering. The compressor 2 comprises a housing 7 which defines an axial inlet 11, a compressor outlet 25, and a volute 12. In the same manner as the compressor shown in FIG. 1, the compressor housing 7 also defines a compressor chamber between the inlet 11 and outlet 25 within which a compressor wheel 6 is rotatably mounted. Rotation of the shaft 8 causes the rotation of the compressor wheel 6.

The compressor housing 7 has two discrete housing portions which are attached to one another. A first housing portion 30 defines at least a portion of the inlet 11. The first housing portion 30 defines a generally cylindrical passage which is generally coaxial with the axis of rotation of the compressor wheel 6 and shaft 8. This generally cylindrical passage defines the compressor inlet 11. A second housing portion 32 defines, at least in part, the compressor chamber between the inlet 11 and outlet 25 within which the compressor wheel 6 is mounted. The second housing portion 32 also defines the volute 12. Within FIG. 2, lines 34a and 34b indicate the border between the first housing portion 30 and the second housing portion 32.

In the embodiment shown in FIG. 2, the first housing portion 30 is formed from a plastic material and the second housing portion 32 is formed from a metal. It will be appreciated that in other embodiments of the invention, the first housing portion 30 and second housing portion 32 may be formed from any appropriate material. In some embodiments, the first housing portion 30 and second housing portion 32 may be formed from the same material.

In the embodiment shown in FIG. 2 an annular insert 31 is received within the inlet 11. In the embodiment shown, the insert 31 is formed from a plastic material.

However, it will be appreciated that in other embodiments the insert 31 may be formed from any appropriate material. The insert 31 may serve at least one of a number of purposes, including use as a noise baffle to reduce noise produced by the compressor; use as part of a map-width enhancing (MWE™) structure; and use as a support which may support part of a sensor arrangement.

The first housing portion 30 has a first sensor arrangement (indicated generally by 38) and a second sensor arrangement 36. The second sensor arrangement 36 has a pressure sensor 40 and an integrated mass flow sensor and temperature sensor 42. It will be appreciated that in some embodiments of the invention the mass flow sensor and temperature sensor need not be integrated. The first sensor arrangement 38 has a temperature sensor and a pressure sensor.

The pressure sensor 40 and the integrated mass flow sensor and temperature sensor 42 are located and configured such that they are in sensing communication with the inlet 11 and hence the gas (in the case of a turbocharger, air) which flows to the compressor wheel 6 via the inlet 11. The phrase "in sensing communication with" should be taken to mean that the sensor is located and configured such that it is capable of measuring the property of the gas for which the sensor is intended, within the portion of the compressor with which the sensor is in "sensing communication". In the embodiment shown in FIG. 2 the pressure sensor is moulded integrally with a wall of the first housing portion 30 which defines the inlet 11. The pressure sensor 40 is moulded integrally with the wall of the first housing portion 30 so that it is exposed to the gas within the inlet 11 so that the sensor 40 may measure the pressure of the gas within the inlet 11. The integrated mass flow sensor and temperature sensor 42 consists of a wire which is moulded integrally with the insert 31, such that the wire is in sensing communication with the gas flowing through the inlet 11.

The wire which is moulded integrally with the insert 31 and which forms part of the integrated mass flow sensor and temperature sensor 42 may be referred to as a "hot wire" sensor. A "hot wire" sensor operates as follows. A current is passed into the wire such that the wire heats up. The resistance of the wire is measured. Because the resistance of the wire varies as a function of the temperature of the wire, measuring the resistance of the wire enables the temperature of the wire to be determined. The flow of a gas (such as air) past the wire as it travels towards the compressor wheel 6 will cool the wire. This is because the flow of the gas past the wire causes heat transfer from the wire to the gas flowing past the wire. The greater the flow rate of gas past the wire (and hence the mass flow rate of gas flowing into the inlet), the greater the heat transfer between the wire and the gas in the inlet. A greater heat transfer between the wire and the gas in the inlet will result in a reduction in the temperature of the wire which can be measured as a change in resistance of the wire. The measured resistance of the wire can also be used to determine the temperature of the gas flowing through the inlet 11.

The first sensor arrangement 38 is arranged such that it protrudes from the first housing portion 30 through an opening 44 in the second housing portion 32 which opens into the volute 12. A seal 46 which surrounds the opening 44 and is located between the first housing portion 30 and second housing portion 32 substantially prevents leakage of gas from within the volute 12 to outside of the compressor via a leak path which may otherwise exist between the first housing portion 30 and second housing portion 32. Furthermore, the seal 46 may also substantially prevent gas from flowing between the compressor chamber and the volute 12 via the opening 44 and a flow path that may otherwise exist between the first housing portion 30 and second housing portion 32.

The temperature sensor and pressure sensor which form part of the first sensor arrangement 38 are exposed to the gas within the volute 12 via the opening 44 and hence can measure the temperature and the pressure of the gas within the volute 12. In some embodiments of the invention the first sensor arrangement may be placed in sensing communication with the compressor outlet 25. In such embodiments the first sensor arrangement may be exposed to gas within the outlet 25.

The opening 44 in the embodiment shown in FIG. 2 is a through-bore which passes all the way into the volute 12. In some embodiments of the invention (for example, an embodiment in which the first sensor arrangement comprises a temperature sensor and no pressure sensor), the opening 44 may be a bore that does not pass all the way through the second housing portion 32 into the volute 12 (i.e. a bore which only passes part way through the second housing portion 32 into the volute 12).

The first housing portion 30 has an electronics enclosure 48. The electronics enclosure 48 houses a conductive element, which in this case comprises a circuit board 50. The circuit board 50 is electrically connected to both the first and second sensor arrangements 38, 36 such that the circuit board 50 can conduct an electric signal from both the first and second sensor arrangements 38, 36. The integrated mass flow sensor and temperature sensor 42 which is moulded integrally with the insert 31 is connected to the circuit board 50 via an electrical plug arrangement 52. The electrical plug arrangement 52 is connected to the circuit board via a conducting member which extends from the electrical plug arrangement 52 through the first housing portion 30 to the circuit board 50 within the electrical enclosure 48. The circuit board 50 is also electrically connected to an electrical connector 54 which forms part of the exterior of the first housing portion. The electrical connector 54 may be used to connect both the second sensor arrangement 36 and first sensor arrangement 38 to the electrical system of the engine of which the turbocharger having the compressor forms part.

As previously discussed, within the embodiment shown in FIG. 2, the first housing portion 30 is formed from a plastic material. The use of a plastic material to form the first housing portion 30 may be advantageous in certain applications because it is easier and cheaper to form complex shapes by the process of plastic moulding compared to other manufacturing methods involving other materials (for example machining metal).

Furthermore, by moulding the first housing portion from plastic material it is possible to form the first housing portion 30 such that components are integrally moulded with the housing portion 30. For example, in the embodiment of the invention shown in FIG. 2, the pressure sensor 40 of the second sensor arrangement 36 and the pressure and temperature sensors of the first sensor arrangement 38 are all moulded integrally with the first housing portion 30.

In some embodiments of the invention it may be advantageous to integrally mould a temperature sensor within a component formed from a plastic material (for example, the first housing portion or an inlet insert). This is because plastic material has a relatively low thermal conductivity (compared to, for example, metal). Because of this, the plastic material will substantially not conduct heat to the temperature sensor from other parts of the compressor and as such the temperature measured by the temperature sensor will be that of the gas to which it is exposed (i.e. there will be little or no contribution to the measured temperature due to heat from other parts of the compressor). For this reason the temperature of the gas measured by the temperature sensor will be more accurate.

The conductive element (for example the circuit board 50) is also integrally moulded within the electronics enclosure 48 of the first housing portion 30. In some embodiments only part of the conductive element may be integrally moulded with the first housing portion 30.

The ability to integrally mould these components with the first housing portion 30 means that it is not necessary to use a three-step process to form the compressor. Such a two-step process involves first forming the compressor and then making bores in the compressor so as to accommodate the sensor arrangements. The sensor arrangements can then be inserted into their respective bores. By avoiding the use of a three-step process to integrate the sensor arrangements with the compressor, the cost and complexity of integrating the sensor arrangements within the compressor are reduced. Furthermore, in some embodiments it may be advantageous to integrate electronic circuitry which conducts an electric signal from the first and/or second sensor arrangements with the compressor. In the described embodiment the electronic circuitry comprises the conductive element which is integrated within the electronic enclosure 48 of the first housing portion 30. By locating the electronics required to conduct an electric signal from the first and/or second sensor arrangement within the compressor, the complexity of the connections that must be made between the engine electronics and the sensor arrangements (and therefore sensors) of the compressor can be reduced. This may reduce the cost of connecting the sensor arrangements to the engine electronics as well as reducing the time it takes to make such connections when installing the turbocharger (and hence compressor) as part of an engine.

It will be appreciated that, in accordance with the invention, by locating the second sensor arrangement in the inlet 11 of the compressor and by locating the first sensor arrangement 38 in the volute 12 or outlet 25 of the compressor (in the case of the described embodiment, in the volute 12 of the compressor), the measurements taken by the sensor arrangements 36, 38 will be measurements of the actual conditions within the compressor. Because of this, the measurements taken by the first sensor arrangement 38 and second sensor arrangement 36 will accurately reflect the conditions within the compressor. This is compared to the measurements merely being representative of the conditions within the compressor, which may be the case in relation to known compressors where a sensor measuring the properties of gas passing through the compressor is located remote from the compressor. For example, a sensor may be located at the inlet manifold of an engine to which the compressor is attached or at an intake system of the engine, upstream of the compressor. For instance, in the case where a sensor is at an intake system of the engine, the sensor may be located in an air filter box or at any other appropriate location within the intake system. The ability to measure the conditions of the gas passing through the compressor more accurately (and hence measuring the operating conditions of the compressor more accurately) enables the compressor to be operated under conditions which are closer to its operational limits (for example, operating the compressor at the limits defined by the material properties of those materials from which the compressor is formed). By operating the compressor closer to its operational limits, the performance of the compressor can be increased (i.e. the maximum possible performance of the compressor can be obtained).

A further advantage of locating the second sensor arrangement in the inlet 11 of the compressor and/or locating the first sensor arrangement 38 in the volute or outlet of the compressor is as follows. As previously mentioned, some known compressors have sensors located at or near the inlet manifold and/or intake system which monitor properties of the gas which passes through the compressor. If a leak in pipework which links the compressor to the engine, or other adverse condition which affects the properties of the gas, occurs at a position which is downstream of the intake system and/or upstream of the inlet manifold then it will not be possible using the sensors located at or near the intake system and/or inlet manifold to determine the position of the leak or other adverse condition. In particular, if a sensor located at or near the inlet manifold measures a property of the gas which is indicative of a leak or other adverse condition, it will not be possible to determine whether the leak or other adverse condition is occurring at the compressor, or within the pipework linking the compressor to the inlet manifold. Similarly, if a sensor located at or near the intake system measures a property of the gas which is indicative of a leak or other adverse condition, it will not be possible to determine whether the leak or other adverse condition is occurring at the compressor, or within the pipe work linking the compressor to the intake system. By locating a sensor within the compressor inlet and/or at the compressor volute or outlet, it may be possible to determine whether a leak or other adverse condition detected by such a sensor is occurring upstream of the compressor or downstream of the compressor respectively. It follows that, if it is determined that a leak or other adverse condition detected by a sensor is occurring upstream of the compressor or downstream of the compressor, then the leak or other adverse condition is not occurring within the compressor. The ability to determine whether or not a leak or other adverse condition is occurring within the compressor (or instead if the leak is occurring elsewhere, for example in pipe work) may be beneficial in some applications of the present invention.

Within the embodiment shown in FIG. 2, the second housing portion 32 is formed from metal. The use of metal as a material from which to form the second housing portion 32 may be beneficial in some embodiments due to the fact it is the second housing portion 32 which defines at least part of the volute 12 and outlet 25. Because the volute 12 and outlet 25 are located downstream of the compressor wheel 6, the volute 12 and outlet 25 will contain, in use, gas which is pressurised (i.e. at a higher pressure compared to gas within the inlet 11 of the compressor 2). Because the gas within the volute 12 and outlet 25 is pressurised, the volute 12 and outlet 25 will be subjected to greater forces due to the presence of the pressurised gas compared to the forces exerted on the inlet 11 by the gas within the inlet. For this reason, it may be advantageous to form the second housing portion 32 from a material which has a greater structural strength than that of the material used to form the first housing portion 30. In some embodiments of the invention, a plastic material may be used to form the second housing portion 32 provided the plastic material has sufficient structural strength to withstand the forces exerted by the pressurised gas within the volute 12 and outlet 25.

One example of the way in which the compressor of the embodiment shown in FIG. 2 may be assembled is as follows. The second housing portion 32 is secured to the bearing housing (not shown in FIG. 2) of the turbocharger whilst the compressor wheel 6 is in situ. Any suitable method and/or fixing may be used to attach the second housing portion 32 to the bearing housing as will be appreciated by a person skilled in the art. Once the second housing portion 32 has been secured to the bearing housing, the first housing portion 30 is secured to the second housing portion 32. In order to achieve this, the first housing portion 30 is orientated such that the first sensor arrangement 38 aligns with the opening 44 in the second housing portion 32. An engagement portion 55 of the first housing portion 30 has an outside diameter which corresponds to the inside diameter of an engagement portion 56 of the second housing portion 32. The first housing portion 30 is aligned with and moved towards the second housing portion 32 such that the engagement portion 55 of the first housing portion 30 is received by the engagement portion 56 of the second housing portion 32. The first housing portion has a shoulder portion 58 which is adjacent the engagement portion and which extends radially outboard of the engagement portion 55. The first housing portion 30 is moved towards the second housing portion 32 until the shoulder portion 58 abuts the second housing portion 32. Whilst the first housing portion 30 is moved towards the second housing portion 32 so that the engagement portion 55 of the first housing portion 30 is received by the engagement portion 56 of the second housing portion 32, the first sensor arrangement 38 is also received by opening 44. Once the first housing portion 30 has been moved towards the second housing portion 32 to an extent where the first engagement portion 55 is received by the second engagement portion 56 and such that the shoulder portion 58 abuts the second housing portion 32, the first housing portion 30 forms a mating fit with the second housing portion 32 such that the first housing portion 30 and second housing portion 32 are contiguous. Once the first housing portion 30 and second housing portion 32 have been assembled together, any appropriate means may be used to secure the first housing portion 30 and second housing portion 32 together.

Alternatively, the compressor shown in the embodiment of FIG. 2 may be assembled by first securing the first housing portion 30 and the second housing portion 32 together, and then securing the second housing portion 32 to the bearing housing of the turbocharger whilst the compressor wheel is in situ.

By constructing the compressor housing from discrete first and second housing portions 30, 32, it is possible to easily place a sensor arrangement (the first sensor arrangement 38 in this case) in sensing communication with the volute 12 or the outlet (the volute 12 in this case) of the compressor without the need to create any holes in the compressor housing after the compressor housing has been formed and/or assembled. Furthermore, once the first housing portion 30 has been secured to the second housing portion 32, the sensor arrangements are in sensing communication with both the inlet 11 and the outlet 12, 25 of the compressor respectively. As such, by assembling the compressor, the sensor arrangements for measuring properties of the gas in the inlet and volute or outlet of the compressor (and hence conditions within the compressor) are correctly located in a single action. Electric signals from the first and second sensor arrangements 36, 38 which provide measurements of the rate of mass flow, temperature, and/or pressure can be provided to engine electronics via the electrical connector 54.

Within the embodiments shown in FIG. 2, the integrated mass flow sensor and temperature sensor 42 is moulded integrally with the insert 31. The insert 31 is inserted into the inlet 11 and may have a snap fit or push fit within the inlet 11. It will be appreciated that any other appropriate means may be used to secure the insert 31 within the inlet 11. The insert 31 may be fitted within the inlet 11 either before or after the first housing portion 30 is attached to the second housing portion 32. Once the insert 31 has been fitted within the inlet 11 defined by the first housing portion 30, the integrated mass flow sensor and temperature sensor 42 is electrically connected to the conductive element (in this case it is connected to the circuit board 50) via an electrical plug 52. It will be appreciated that any appropriate electrical connection may be used to connect the integrated mass flow sensor and temperature sensor 42 with the conductive element of the electrical enclosure 48. Furthermore, it will be appreciated that in some embodiments of the invention, the insert 31 may be omitted and the integrated mass flow sensor and temperature sensor may be moulded integrally with or mounted to a wall of the first housing portion 30 which defines, at least in part, the inlet 11.

Within the embodiment of the invention shown in FIG. 2, it can be seen that the second sensor arrangement 36 has an integrated mass flow sensor and temperature sensor 42 and a pressure sensor 40. The first sensor arrangement 38 has a temperature sensor and a pressure sensor. It will be appreciated that the first and second sensor arrangements may comprise any number of sensors and that the sensors which form part of the first and second sensor arrangements may be of any type suitable for measuring a property of the gas within the compressor inlet or compressor outlet. Furthermore, whilst the integrated mass flow sensor and temperature sensor 42 and pressure sensor 40 of the second sensor arrangement 36 are spaced from one another, and whilst the temperature sensor and pressure sensor of the first sensor arrangement 38 are located together, this need not be the case. For example, the second sensor arrangement 36 may comprise only one sensor or a plurality of sensors which are located together, and the first sensor arrangement 38 may be such that it has only one sensor or a plurality of sensors which are located separately from one another (provided that the sensor(s) of the sensor arrangement 38 are located such that they are in sensing communication with the volute or outlet).

In the embodiment shown, the annular insert 31 which is received by the inlet 11 has a map width enhancing (MWE™) function. This need not be the case in alternative embodiments. The insert 31 defines, at least in part, a substantially annular passageway 59 between a portion of the inlet 11 upstream of the compressor wheel 6 and a location which is generally adjacent the compressor wheel 6. The substantially annular passageway 59 (also referred to as the MWE™ passageway) defines, at least in part, a fluid (in this case air) flow path 60. The direction of fluid flow through the passageway 59 may be in either direction depending on compressor operating conditions. The passageway 59 may increase the amount of fluid reaching the compressor wheel during high flow and/or high compressor wheel 6 revolution speed operation of the compressor. The passageway 59 may also recirculate fluid to the portion of the inlet 11 upstream of the compressor wheel 6 during low flow operation of the compressor. Such an arrangement results in improved stability at a wide range of compressor wheel revolution speeds and a shift in the characteristics of the compressor. This shift can be represented as a widening of a standard "map" which plots the total pressure ratio of the compressor against corrected air flow. If an MWE™ passageway is provided, the second sensor arrangement may be configured such that it can measure at least one property of the fluid flowing through the MWE™ passageway and at least one property of the fluid flowing through a portion of the inlet which is not the MWE™ passageway. For example, the second sensor arrangement may have two separate sensors, one which is in sensing communication with the MWE™ passageway and one which is in sensing communication with a portion of the inlet which is not the MWE™ passageway.

Numerous modifications and variations may be made to the exemplary design described above without departing from the scope of the invention as defined in the claims.

The embodiment of the invention described above relates to a compressor that forms part of a turbocharger. The embodiment described above also operates in conjunction with air. A compressor according to the present invention need not form part of a turbocharger. For example, the compressor wheel may not be driven by exhaust gas flow, but may be driven by an alternative fluid (e.g. gas or liquid) flow or a motor. Furthermore, the compressor may operate in conjunction with (i.e. compress) any appropriate fluid (e.g. gas or fluid).

The embodiment of the invention described above has a first sensor arrangement which is moulded integrally with the first housing portion. The second housing portion has an opening which receives the first sensor arrangement such that the first sensor arrangement is placed in sensing communication with the volute or outlet of the compressor when the first and second housing portions are attached together. In some embodiments of the invention at least one sensor of the first sensor arrangement may not be moulded integrally with the first housing portion. For example, in an embodiment where the second housing portion is formed from a mouldable material (for example plastic material), at least one sensor of the first sensor arrangement may be moulded integrally with the second housing portion. In another embodiment, a sensor of the first sensor arrangement may not be integrally moulded with either the first or second housing portion. Instead, the sensor may be a push-fit into an opening in either the first housing portion or second housing portion. Alternatively, the sensor of the first sensor arrangement may be inserted between the first and second housing portions before they are assembled together, the sensor then being secured in position between the first and second housing portions when the first and second housing portions are secured together. In embodiments of the invention where a sensor of the first sensor arrangement is not moulded integrally with the first housing portion, said sensor may be electrically connected with the conductive element (e.g. circuit board) of the first housing portion using any appropriate electrical connector. For example, the sensor may be electrically connected to the conductive element of the first housing portion via an electrical plug. The electrical plug may be such that when the first housing portion is urged towards the second housing portion (as the first and second housing portions are attached together), the electrical plug (which in this example forms part of the first housing portion) receives part of the sensor of the first sensor arrangement to thereby electrically connect the conductive element of the first housing portion to the sensor.

In at least one above described embodiment the compressor has a first sensor arrangement in sensing communication with the outlet or volute. The compressor also has a first housing portion which has both a conductive element for conducting an electric signal and a second sensor arrangement in sensing communication with the compressor inlet. The first sensor arrangement is electrically connected to the conductive element. In some embodiments of the invention a sensor which measures a property of the gas in the compressor inlet may not be required and so the second sensor arrangement may be omitted.

In the above described embodiments the compressor has a conductive element, which comprises a circuit board 50. It will be appreciated that any appropriate conductive element may be used. For example, the conductive element may comprise a moulded interconnect portion. A moulded interconnect portion may be of a moulded interconnect device (MID) type. In a moulded interconnect device a conductive portions are created within a polymer material by means of a local modification of the structure of the polymer material (e.g. a thermoplastic). Such a local modification of the structure of the polymer material may be effected by a laser. In one example, the MID may be created using a Laser Direct Structuring (LDS) technique. One type of LDS technique uses a polymer material (e.g. thermoplastic) which is doped with a conductive additive. The conductive additive is activated by means of laser. The conductive additive may be a metal containing additive. The laser is used to selectively write a path of a conductive portion within the polymer material. Where the laser beam is incident on the polymer material, the conductive additive forms a base path. The conductive additive which has been activated by the laser (i.e. the base path) forms nucleation sites for subsequent addition of a conductive material. For example, the polymer material which has a base path may be dipped in a metal bath such as a electrodeless copper bath. The metal of the metal bath will be deposited on the base path.

While the invention has been illustrated and described in detail in the drawings and foregoing description, the same is to be considered as illustrative and not restrictive in character, it being understood that only the preferred embodiments have been shown and described and that all changes and modifications that come within the scope of the inventions as defined in the claims are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. A compressor comprising:

a housing defining an inlet, a volute, an outlet, and a compressor chamber between the inlet and the outlet within which a compressor wheel is rotatably mounted, the housing having discrete attached first and second housing portions, the first housing portion defining at least part of the inlet and the second housing portion defining at least part of the volute, the first housing portion having a conductive element for conducting an electric signal, wherein the compressor further comprises a first sensor arrangement, the first sensor arrangement being configured such that it is in sensing communication with the outlet or volute, and such that it is electrically connected to the conductive element, wherein the first housing portion comprises a second sensor arrangement in sensing communication with the inlet, and wherein the first housing portion further comprises an electric connector which is electrically linked both to the second sensor arrangement and, via the conductive element, to the first sensor arrangement.

2. A compressor according to claim 1, wherein the second housing portion comprises a first sensor arrangement.

3. A compressor according to claim 2, wherein the first sensor arrangement is placed in sensing communication with the volute or outlet via a bore or through-bore in the second housing portion.

4. A compressor according to claim 2, wherein the first housing portion is formed from a plastic material.

5. A compressor according to either claim 1, wherein the first housing portion comprises the first sensor arrangement.

6. A compressor according to claim 5, wherein the first sensor arrangement is placed in sensing communication with the volute or outlet via a bore or through-bore in the second housing portion.

7. A compressor according to claim 1, wherein the first sensor arrangement is placed in sensing communication with the volute or outlet via a bore or through-bore in the second housing portion.

8. A compressor according to claim 7, wherein the bore or through-bore extends from adjacent the first housing portion, generally away from the first housing portion.

9. A compressor according to claim 1, wherein the first housing portion is formed from a plastic material.

10. A compressor according to claim 1, wherein the second sensor arrangement comprises at least one of a pressure sensor, a temperature sensor and a mass flow sensor.

11. A compressor according to claim 1, wherein the first sensor arrangement comprises at least one of a pressure sensor, a temperature sensor and a mass flow sensor.

12. A compressor according to claim 1, further comprising a generally annular insert which is received by the inlet, wherein at least a part of the second sensor arrangement is mounted on the insert.

13. A method of constructing a compressor, the compressor having a housing defining an inlet, a volute, an outlet, and a compressor chamber between the inlet and the outlet within which a compressor wheel is rotatably mounted, wherein the housing comprises first and second discrete housing portions, the first housing portion defining at least part of the inlet and the second housing portion defining at least part of the volute, the first housing portion having a conductive element for conducting an electric signal, the compressor further comprising a first sensor arrangement, wherein the first housing portion comprises a second sensor arrangement, and wherein the first housing portion further comprises an electrical connector, the method comprising:

attaching the first and second housing portions such that the first sensor arrangement is placed in physical sensing communication with the volute or outlet, and such that the first sensor arrangement is electrically connected to the conductive element; and placing the second sensor arrangement in sensing communication with the inlet, and electrically linking the electric connector both to the second sensor arrangement and, via the conductive element, to the first sensor arrangement.

* * * * *